US010393468B2

(12) United States Patent
Maugham

(10) Patent No.: US 10,393,468 B2
(45) Date of Patent: Aug. 27, 2019

(54) AMBIDEXTROUS LOWER RECEIVER FOR AN AUTOMATIC RIFLE

(71) Applicant: Christopher Matthew Maugham, Atlantis, FL (US)

(72) Inventor: Christopher Matthew Maugham, Atlantis, FL (US)

(73) Assignee: MVB INDUSTRIES, INC., Deerfield Beach, FL (US)

( * ) Notice: Subject to any disclaimer, the term of this patent is extended or adjusted under 35 U.S.C. 154(b) by 0 days.

(21) Appl. No.: 16/145,148

(22) Filed: Sep. 27, 2018

(65) Prior Publication Data

US 2019/0093978 A1 Mar. 28, 2019

Related U.S. Application Data

(60) Provisional application No. 62/563,778, filed on Sep. 27, 2017.

(51) Int. Cl.

| | |
|---|---|
| ***F41A 35/06*** | (2006.01) |
| ***F41A 19/11*** | (2006.01) |
| ***F41A 11/02*** | (2006.01) |
| ***F41A 3/66*** | (2006.01) |
| ***F41A 17/36*** | (2006.01) |

(52) U.S. Cl.

CPC ..... *F41A 35/06* (2013.01); *F41A 3/66* (2013.01); *F41A 11/02* (2013.01); *F41A 17/36* (2013.01); *F41A 19/11* (2013.01)

(58) Field of Classification Search

CPC ..... F41A 3/36; F41A 3/38; F41A 3/42; F41A 17/36; F41A 17/42; F41A 35/06

USPC ..... 89/181, 190

See application file for complete search history.

(56) References Cited

U.S. PATENT DOCUMENTS

| | | | | |
|---|---|---|---|---|
| 3,821,920 | A * | 7/1974 | Brieger | F41A 3/70 89/132 |
| 4,521,985 | A * | 6/1985 | Smith | F41A 35/06 42/7 |
| 4,759,144 | A * | 7/1988 | Egan | F41A 17/38 42/7 |
| 5,519,954 | A * | 5/1996 | Garrett | F41A 17/38 42/6 |
| 8,572,875 | B2 * | 11/2013 | Sisgold | F41A 17/36 42/1.02 |
| 2010/0275485 | A1 * | 11/2010 | Findlay | F41A 17/36 42/16 |
| 2011/0056107 | A1 * | 3/2011 | Underwood | F41A 9/59 42/18 |

(Continued)

*Primary Examiner* — Bret Hayes

(57) ABSTRACT

An ambidextrous lower receiver for an automatic rifle is an apparatus that allows a rifle bolt of an upper receiver that is mounted on the apparatus to be manipulated from either side of the automatic rifle. The apparatus includes a lower-receiver body, a bolt catch button, a bolt catch lever, a pusher finger, and a length-adjustable pin. The lower-receiver body attaches with the upper receiver of an automatic rifle and connects a magazine and a pistol grip to the automatic rifle. The lower-receiver body positions the bolt catch button and the bolt catch lever. The bolt catch button releases and locks the bolt catch lever. The bolt catch lever releases and locks the rifle bolt of a corresponding upper receiver. The bolt catch button manipulates the bolt catch lever from the opposite side of the automatic rifle with the pusher finger and the length-adjustable pin.

11 Claims, 9 Drawing Sheets

(56) References Cited

U.S. PATENT DOCUMENTS

| | | | | |
|---|---|---|---|---|
| 2012/0167424 | A1* | 7/2012 | Gomez | F41A 17/42<br>42/14 |
| 2015/0323271 | A1* | 11/2015 | McGinty | F41A 35/06<br>42/17 |
| 2016/0282070 | A1* | 9/2016 | Orne, III | F41A 3/72 |
| 2017/0160026 | A1* | 6/2017 | Walther | F41A 3/66 |
| 2017/0284761 | A1* | 10/2017 | Lewis | F41A 3/66 |
| 2018/0347925 | A1* | 12/2018 | Gibbens | F41A 3/66 |

* cited by examiner

AMBIDEXTROUS LOWER RECEIVER FOR AN AUTOMATIC RIFLE

The current application claims priority to U.S. provisional application Ser. No. 62/563,778 filed on Sep. 27, 2017.

FIELD OF THE INVENTION

The present invention generally relates to firearms. More specifically, the present invention is an ambidextrous lower receiver for an automatic rifle.

BACKGROUND OF THE INVENTION

Firearms have existed in some form for hundreds of years. As technology progressed, firearms developed from single shot muskets to pistols and rifles capable of storing and handling multiple rounds during a firing session. While single-action revolvers, pump-actuated rifles, bolt-action rifles, and other firearms required some additional manipulation to move between spent rounds and live rounds, other semi-automatic or automatic firearms were developed that automatically discharge a spent round, load a new round in a firing chamber, and cock a firing pin without additional steps carried out by the person shooting the firearm. Often times spring loaded magazines or clips of ammunition are used by these firearms to feed another round into the firing chamber after a spent round has been ejected. When all of the rounds of the magazine have been used, the magazine can be disengaged from the firearm, and another magazine holding live ammunition can be inserted into the firearm.

While the actual method of disengaging a magazine from a firearm can vary widely between different styles of firearms, many firearm manufacturers developed a spring-loaded mechanism positioned on one side of the firearm that when activated would release a mechanical device retaining the magazine in the firearm. This mechanical retaining device advantageously holds the magazine of ammunition in the firearm so that movement of the firearm and forces placed upon the firearm during practice or combat will not unexpectedly cause the magazine to be separated from the firearm. The developed magazine release mechanism allows the mechanical retaining device to securely hold the magazine while providing a means to quickly release the retaining device so that a magazine may be removed when empty and replaced with another magazine loaded with ammunition. In some firearms, when the magazine release mechanism is activated, the magazine will drop from the firearm due to gravity when the firearm is oriented in a substantially horizontal position with the magazine facing downward.

Additionally, a frequent issue with the process of rapidly-firing firearms using spring-loaded magazines of ammunition is the occurrence of jams during the ejection and feeding cycles. Jams often occur because a round is not correctly ejected or loaded into the firing chamber, or when multiple rounds are simultaneously fed from the magazine toward the firing chamber. When a firearm jams, the jam must be cleared before the firearm will be operational again.

In many firearms, clearing a jam requires multiple steps that require both hands of an operator. For example, clearing a jam on a semi-automatic rifle for a right handed operator may require the steps of (a) removing left hand from firing position on barrel hand guard, (b) grabbing the front of the magazine well with the left hand and placing the left thumb on the bolt catch, (c) removing the right hand from the firing grip, (d) pulling the charging handle to the rear with the right hand until the bolt locks, (e) returning the right hand to the grip, (f) pushing the magazine release button with the index finger of the right hand while removing the magazine with the left hand, (g) grabbing the front of the magazine well again with the left hand, (h) running the charging handle three times with the right hand, (i) locking the bolt to the rear with the left hand on the third time, (j) returning the right hand to the firing grip, (k) retrieving and inserting a loaded magazine with the left hand, (l) pressing the bolt release with the left hand, and (m) returning the left hand to the firing position on the barrel hand guard.

While this standard process effectively clears jams in the chamber of the firearm, it has a number of problems. For example, in combat situations, the configuration of the firearm requires an operator to remove his or her right hand (the trigger hand) from the firing grip twice to pull the bolt back and charge the firearm during this standard clearing process. Removing the right hand slows down the clearing process and may be less safe because the right hand is displaced from the firing grip. Here, the time required to clear the jam may leave one defenseless long enough to be shot by an attacker. Additionally, in newer operators, the removal of the right hand may result in less control of the firearm. That is, instead of controlling the positioning of the firearm, including maintaining a safe direction of directing the barrel of the firearm, by maintaining contact on the firing grip, the current configuration of the firearm and standard clearing process lends itself to more careless control of the firing direction of the firearm in newer users. These and other issues are addressed by embodiments of the present concept.

The present invention adds the ability to manipulate the bolt catch from the opposite side of the receiver than the bolt catch is located. While ostensibly appearing to be a form of a bolt catch release lever currently marketed by a number of manufacturers it differs by allowing complete manipulation of the bolt catch, both engaging and disengaging the bolt catch thereby allowing for the fastest and safest manipulation of the firearm. Additionally, by automatically switching between engaging the bolt catch if disengaged or disengaging the bolt catch if engaged, the present invention allows for intuitive use without the need for excessive training or retraining.

DETAIL DESCRIPTIONS OF THE INVENTION

Figure 1:
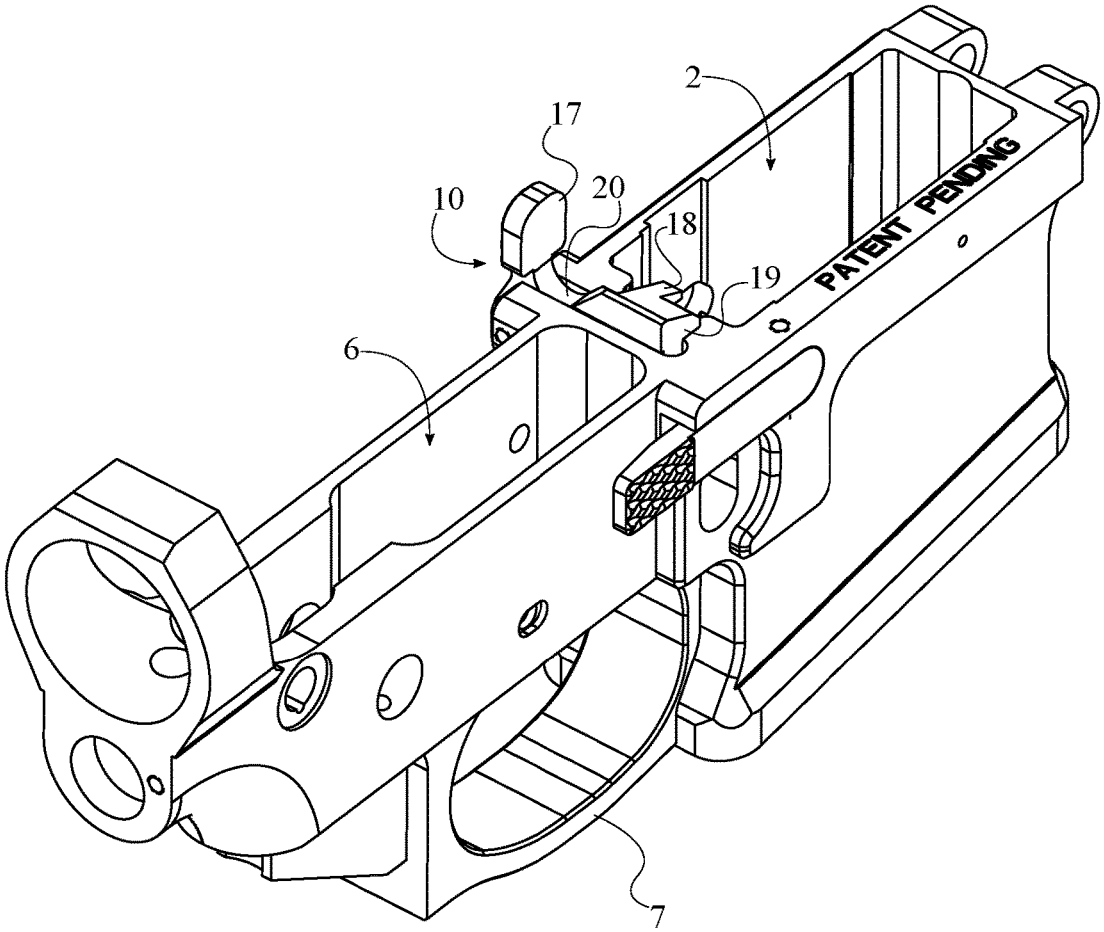
FIG. 1 is a perspective view of the present invention.

All illustrations of the drawings are for the purpose of describing selected versions of the present invention and are not intended to limit the scope of the present invention.

The present invention is an ambidextrous lower receiver for automatic rifles. The present invention safely and quickly engages a rifle bolt of an upper receiver. The present invention limits the movements and actions required to clear the malfunction as the present invention may be engaged along the left and right sides of the automatic rifle. The present invention automatically selects modes depending on the position of the rifle bolt within the bolt carrier assembly of the corresponding upper receiver. Moreover, with the rifle bolt in the unlocked position, engaging the present invention locks the position of the rifle bolt within the corresponding upper receiver. With the rifle bolt in the locked position, engaging the present invention releases the rifle bolt within the corresponding upper receiver. In order for the present invention to be controlled along either sides of the automatic rifle, the present invention comprises a lower-receiver body 1, a bolt catch button 9, a bolt catch lever 10, a pusher finger 22, and a length-adjustable pin 25, seen in FIG. 1, FIG. 2, and FIG. 3. The lower-receiver body 1 connects and positions the bolt catch button 9 and the bolt catch lever 10 with the automatic rifle. The lower-receiver body 1 comprises a magazine chamber 2, an actuation chamber 3, a lever slot 4, ad a button slot 5. The magazine chamber 2 receives and connects a magazine with the automatic rifle. The magazine chamber 2 allows the bullets within the magazine to transfer from the lower-receiver body 1 to an upper receiver that is mounted onto the lower-receiver body 1. The actuation chamber 3 positions the length-adjustable pin 25 within the lower-receiver body 1 and connects the button lever slot 4 with the button slot 5. The lever slot 4 positions the bolt catch lever 10 within the lower-receiver body 1 and allows the bolt catch lever 10 to pivot within the lower-receiver body 1. The button slot 5 positions the bolt catch button 9 within the lower-receiver body 1 and allows the bolt catch button 9 to traverse into and out of the lower-receiver body 1. The bolt catch button 9 retracts and extends the bolt catch lever 10. Moreover, the bolt catch button 9 engages and disengages the bolt catch lever 10. The pusher finger 22 and the length-adjustable pin 25 allow the bolt catch button 9 to retract and extend the bolt catch lever 10 without the bolt catch lever 10 being manually operated by a user.

The overall configuration of the aforementioned components allows the bolt catch of an upper receiver to be engaged from both sides of the automatic rifle. In order to transfer cartridges into the barrel of a rifle and secure a magazine within the rifle, the magazine chamber 2 traverses through the lower-receiver body 1. The actuation chamber 3 is positioned adjacent to the magazine chamber 2 so that the bolt catch button 9 and the bolt catch lever 10 are positioned adjacent the bolt catch lever 10 of the upper receiver of the rifle. The lever slot 4 and the button slot 5 laterally traverse through the lower-receiver body 1 and into the actuation chamber 3. Moreover, the lever slot 4 is positioned opposite to the button slot 5 across the actuation chamber 3, thereby allowing the bolt catch lever 10 to be accessed from the opposite side of the lower-receiver body 1. The bolt catch lever 10 is pivotally mounted within the lever slot 4. Similarly, the bolt catch button 9 is slidably engaged within the button slot 5. The bolt catch lever 10 is extended and retracted from within the lever slot 4 as the first end 23 of the pusher finger 22 is pivotally mounted onto the bolt catch button 9, and the length-adjustable pin 25 is operatively coupled in between the pusher finger 22 and the bolt catch lever 10, wherein the length-adjustable pin 25 causes the pusher finger 22 and the bolt-catch lever 10 to rotate toward each other.

Figure 2:
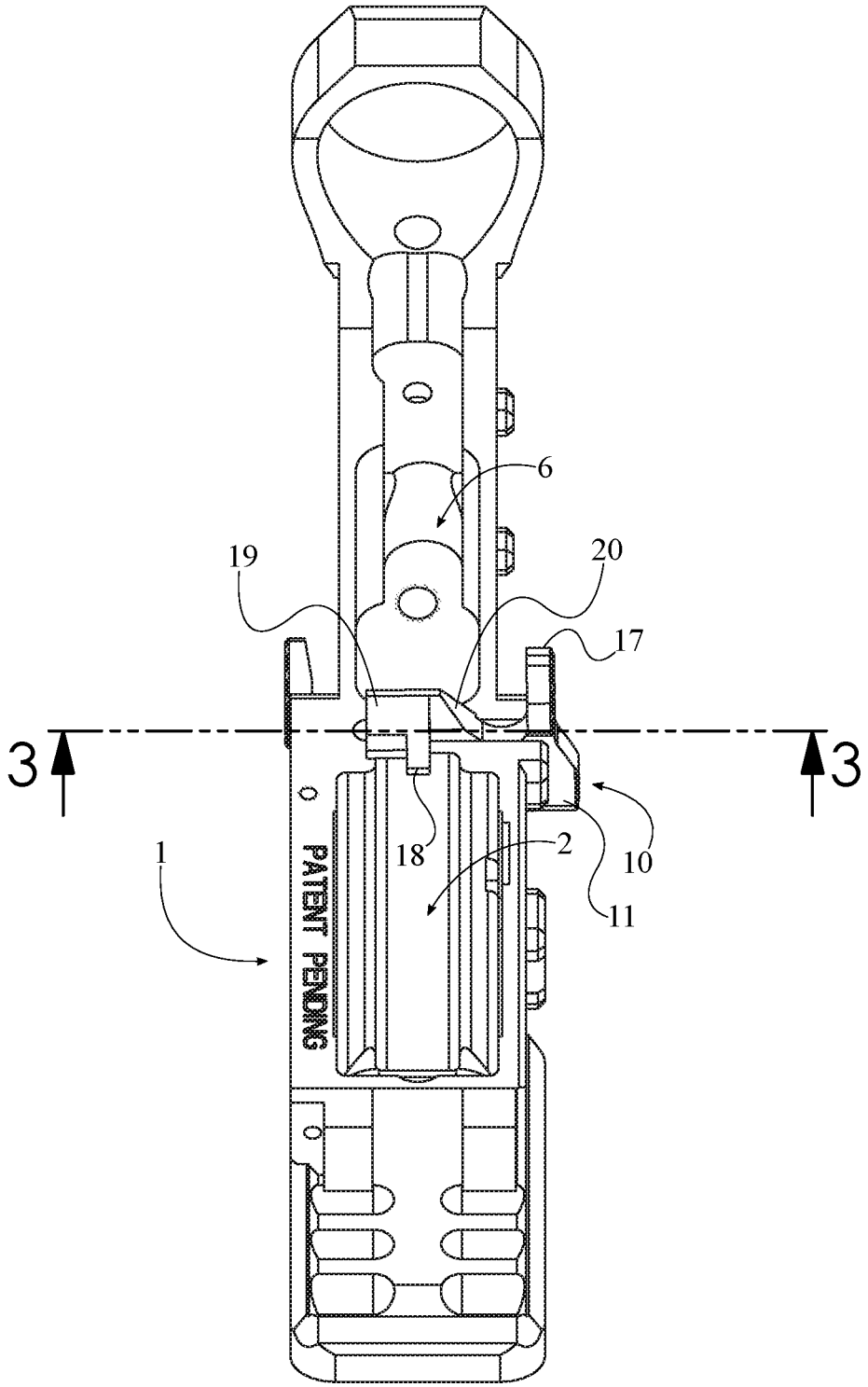
FIG. 2 is a top side view of the present invention with a bolt catch lever and a bolt catch button in a retracted configuration.

In order for the lower-receiver body 1 to effectively connect with an automatic rifle, the lower-receiver body 1 further comprises a trigger mechanism chamber 6 and a trigger guard 7, seen in FIG. 1 and FIG. 2. The trigger mechanism chamber 6 houses a trigger mechanism of the automatic rifle and the trigger guard 7 shields a trigger of the automatic rifle. Similar to the magazine chamber 2, the trigger mechanism chamber 6 traverses through the lower-receiver body 1. The trigger mechanism chamber 6 is positioned adjacent to the actuation chamber 3, opposite the magazine chamber 2 along the lower-receiver body 1, accommodating the position of the trigger mechanism of the automatic rifle. The trigger guard 7 is connected adjacent to the lower-receiver body 1 and is positioned adjacent the trigger mechanism chamber 6 along the lower-receiver body 1, effectively shielding the trigger.

The bolt catch lever 10 engages a rifle bolt of the bolt carrier assembly as the bolt catch lever 10 comprises a main plate 11, a release tab 17, a locking tab 18, and a stopping plate 19, shown in FIG. 1, FIG. 2, FIG. 3, FIG. 4, FIG. 5, FIG. 6, FIG. 7, FIG. 8, and FIG. 9. The main plate 11 connects the release tab 17, the locking tab 18, and the stopping plate 19 to the lower-body receiver. Furthermore, the main plate 11 allows the release tab 17, the locking tab 18, and the stopping plate 19 to pivot while remaining connected within the lever slot 4. The release tab 17 allows a user to directly lock and unlock the rifle bolt with the locking tab 18. The user presses on the release tab 17 in order to retract the locking tab 18 and the stopping plate 19. The stopping plate 19 connects the locking tab 18 to the main plate 11 and allows the locking tab 18 to rest on the lower-receiver body 1. In order for the main plate 11 to rotate and position the locking tab 18 into the bolt carrier assembly, a rotation axis 12 of the main plate 11 is oriented parallel to a sagittal plane 8 of the lower-receiver body 1. The release tab 17 and the stopping plate 19 are fixed to the main plate 11, externally positioned adjacent the lever slot 4. This arrangement allows the release tab 17 to be accessible by a user. Moreover, the stopping plate 19 is fixed to a first outer edge 13 of the main plate 11, opposite the release tab 17. A second outer edge 14 of the main plate 11 is positioned adjacent and oriented perpendicular to the first outer edge 13. The locking tab 18 is terminally fixed to the stopping plate 19, opposite the main plate 11 in order to fully extend within the bolt carrier assembly of a corresponding upper receiver. Moreover, the stopping plate 19 is oriented perpendicular to the main plate 11 and the locking tab 18. The locking tab 18 is oriented towards the magazine chamber 2, allowing the rifle bolt to freely move within the bolt carrier assembly of the upper receiver when the bolt catch lever 10 is in a retracted configuration. While in the retracted configuration, the stopping plate 19 presses on the lower-receiver body 1 and the locking tab 18 is not engaged with the rifle bolt of the upper receiver. In the preferred embodiment of the present invention, the bolt catch lever 10 further comprises a relief cut 20. The relief cut 20 allows a corresponding upper receiver to attach with the lower-receiver body 1. More specifically, the relief cut 20 is a clearance cut for an adjacent sidewall of the upper receiver. The relief cut 20 traverses into the main plate 11 and is positioned along the first outer edge 13, between the release tab 17 and the stopping plate 19.

In order for the bolt catch button 9 to engage the bolt catch lever 10 with the pusher finger 22, the present invention further comprises a locking groove 30, and the bolt catch lever 10 further comprises a lip 21. The locking groove 30 hooks onto the lip 21 and locks the main plate 11 in the retracted configuration within the lever slot 4, seen in FIG. 3. The lip 21 is positioned within the lever slot 4 and is connected adjacent to the first portion 15. The main plate 11 further comprises a first portion 15 and a second portion 16. The first portion 15 supports the stopping plate 19 and the locking tab 18. The second portion 16 engages with the length-adjustable pin 25. Moreover, the user may press on the second portion 16 such that the bolt catch lever 10 pivots clockwise and extends the stopping plate 19 and the locking tab 18. The second portion 16 is terminally fixed to the first portion 15, and the first portion 15 is oriented perpendicular to the second portion 16. The lip 21 is connected adjacent to the first portion 16. The locking groove 30 traverses into the second end 24 of the pusher finger 22, opposite the bolt catch button 9. This arrangement counteracts the natural bias of main plate 11 within the lever slot 4 and the position of the pusher finger 22 with respect to the first portion 15 and the second portion 16. Moreover, the lip 21 engages into the locking groove 30.

Figure 5:
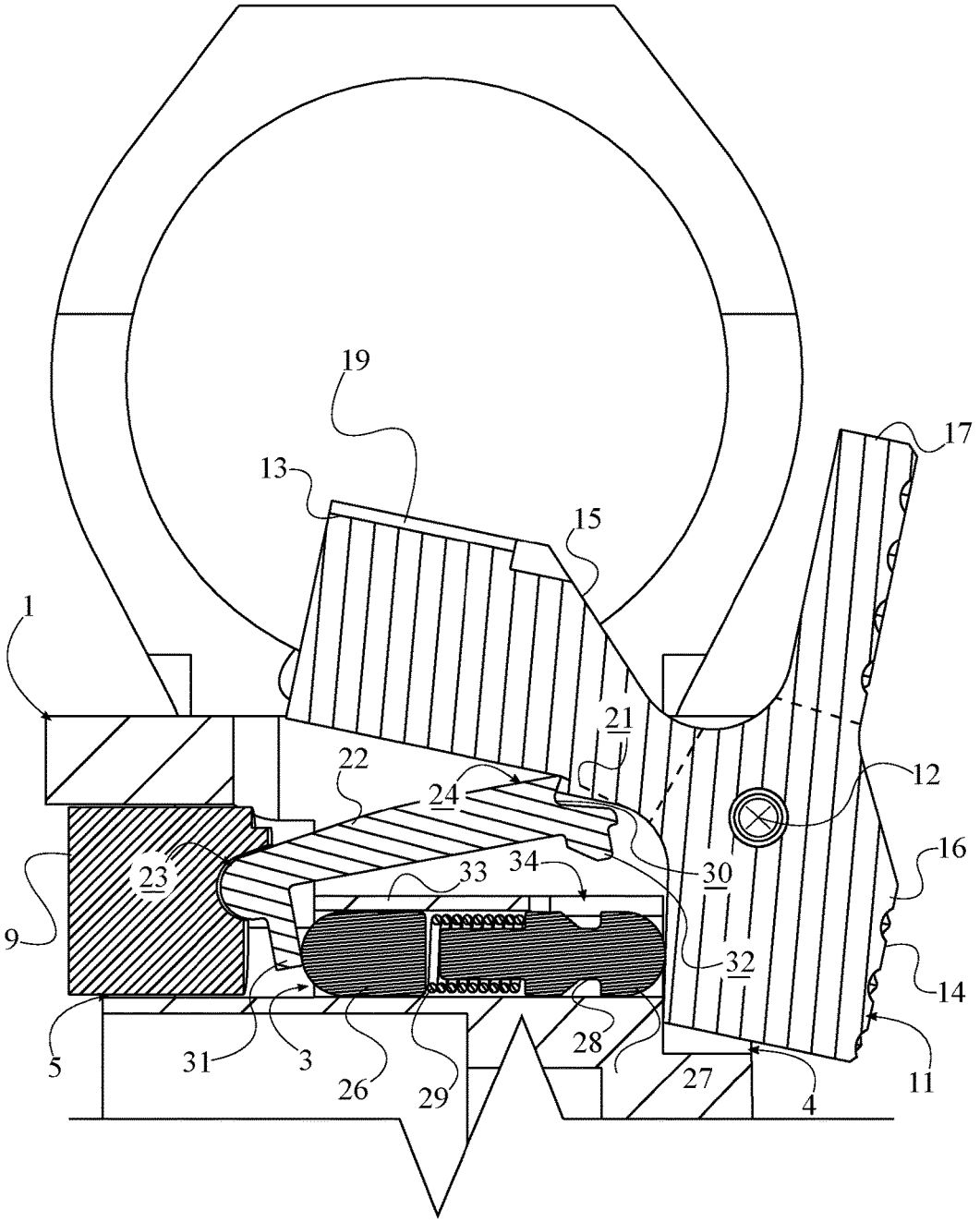
FIG. 5 is a cross-section view of FIG. 4 along line 5-5 of the present invention.

The present invention further comprises a pushing tab 31 and a hooking tab 32 in order for the bolt catch button 9 to engage the bolt catch lever 10 with the pusher finger 22 and the length-adjustable pin 25. The length-adjustable pin 25 also comprises a first rod 26, a second rod 27, a finger groove 28, and a spring 29. The pushing tab 31 engages with the first rod 26 in order to release the bolt catch lever 10, as seen in FIG. 5. The hooking tab 32 engages with the second rod 27 in order to lock the bolt catch lever 10 in a retracted configuration within the lever slot 4, seen in FIG. 9. The first rod 26 pushes against the pushing tab 31, and the second rod 27 pushes against the main plate 11. More specifically, the second rod 27 pushes against the second portion 16 of the main plate 11. The finger groove 28 attaches the hooking tab 32 with the second rod 27. The spring 29 allows the first rod 26 to push against the pushing tab 31, and consequently the bolt catch button 9 with the pusher finger 22. The spring 29 also allows the second rod 27 to push against the bolt catch lever 10, specifically the second portion 16 of the main plate 11. The first rod 26 and the second rod 27 remain connected to each other with the spring 29. In order for the bolt catch button 9 to engage the bolt catch lever 10, the pushing tab 31 is connected adjacent to the first end 23 of the pusher finger 22. In order for the bolt catch button 9 to lock the main plate 11 in the retracted configuration, the hooking tab 32 is connected adjacent to the second end 24 of the pusher finger 22, opposite to the bolt catch button 9. The first rod 26 is pressed against the pushing tab 31, and the second rod 27 is pressed against the bolt catch lever 10. The spring 29 is connected in between the first rod 26 and the second rod 27. The finger groove 28 laterally traverses into the second rod 27, and the hooking tab 32 engages into the finger groove 28.

Figure 7:
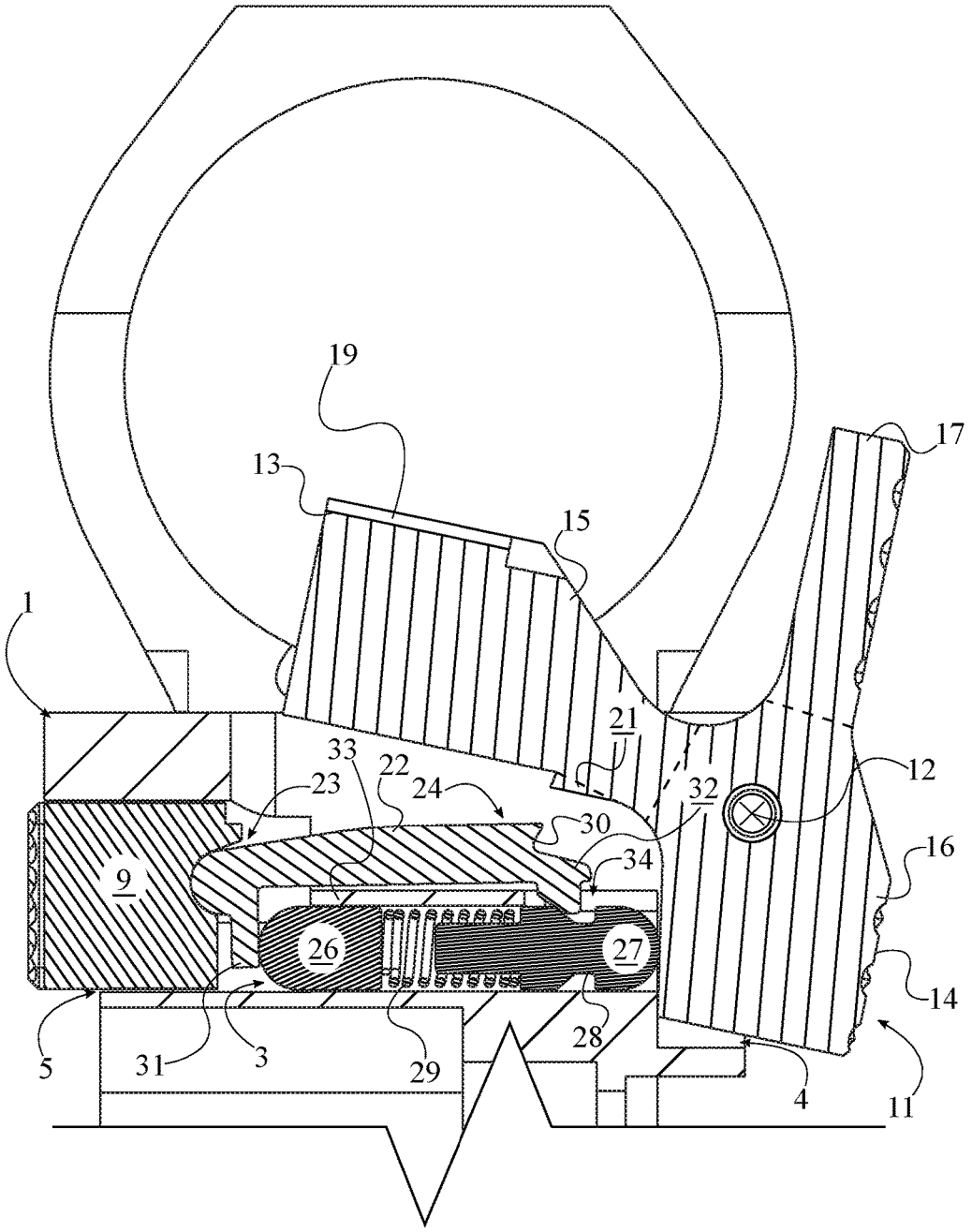
FIG. 7 is a cross-section view of FIG. 6 along line 7-7 of the present invention.
Figure 9:
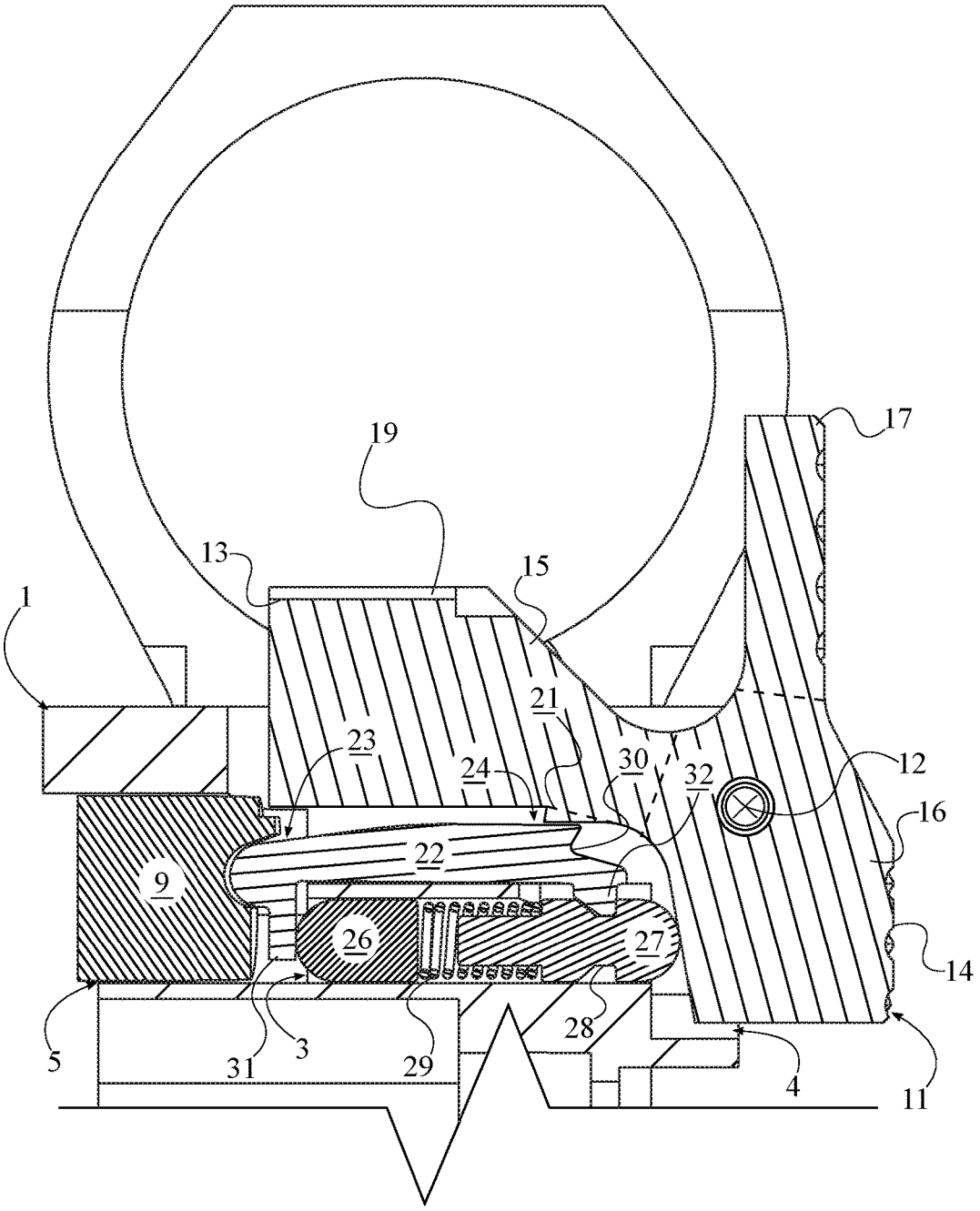
FIG. 9 is a perspective view of the present invention.

In order to position the pusher finger 22 and the length-adjustable pin 25 within the actuation chamber 3, the present invention further comprises a pin tube 33 and a pusher slot 34, shown in FIG. 5, FIG. 7, and FIG. 9. The pin tube 33 orients and positions the length-adjustable pin 25 between the button slot 5 and the lever slot 4. The pusher slot 34 allows the hooking tab 32 to engage with the length-adjustable pin 25 through the pin tube 33. The pin tube 33 is mounted within the actuation chamber 3, thereby housing the length-adjustable pin 25. The length-adjustable pin 25 is slidably engaged within the pin tube 33, and the pin tube 33 is positioned in between the pusher finger 22 and the length-adjustable pin 25. This arrangement allows the first rod 26 to press against the pushing tab 31. Similarly, this arrangement allows the second rod 27 to press against the bolt catch lever 10. The pusher slot 34 is positioned adjacent to the bolt catch lever 10 and laterally traverses into the pin tube 33. The hooking tab 32 engages through the pusher slot 34 and into the finger groove 28. The bolt catch button 9 engages the bolt catch lever 10 with the pusher finger 22 and the length-adjustable pin 25 as the spring 29 forces the second rod 27 towards the bolt catch lever 10, wherein the displacement of the second rod 27 causes the bolt catch lever 10 to rotate about the pivoting connection with the lower-receiver body 1. Moreover, the spring 29 forces the first rod 26 towards the pushing tab 31, wherein displacement of the first rod 26 causes the pusher finger 22 to rotate about the pivoting connection with the bolt catch button 9.

Figure 3:
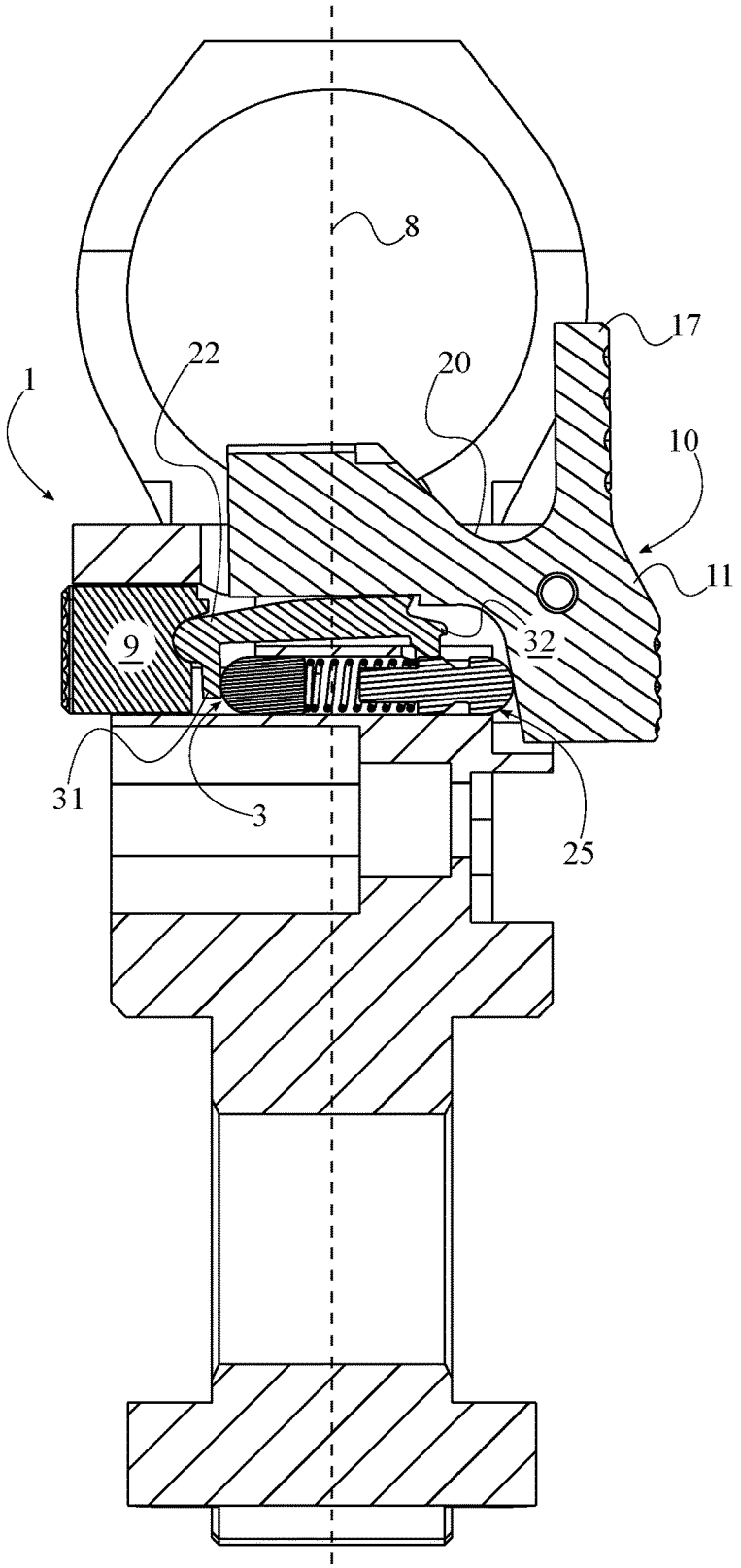
FIG. 3 is a cross-section view of FIG. 2 along line 3-3 of the present invention
Figure 4:
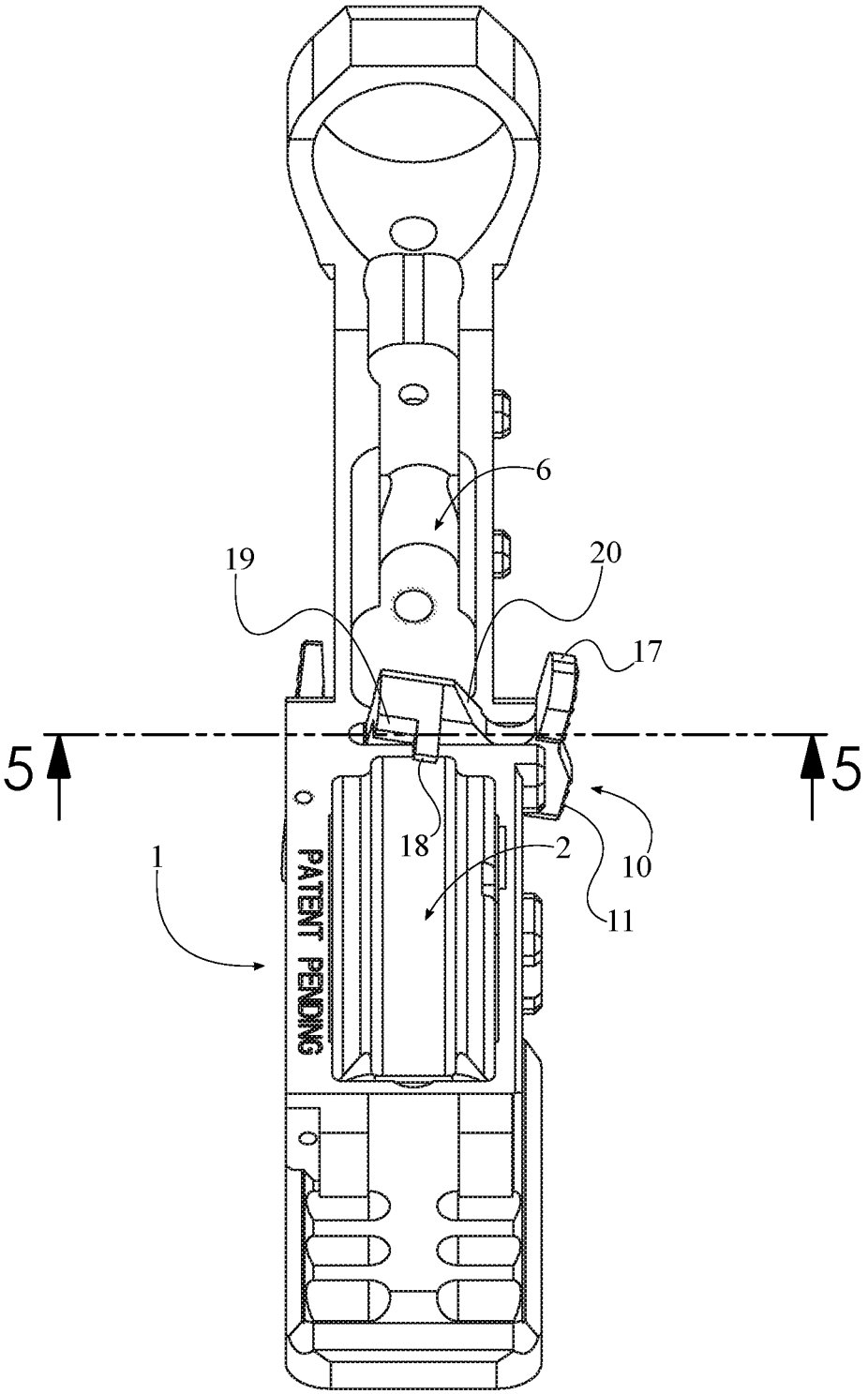
FIG. 4 is a top side view of the present invention with the bolt catch button partially engaged and the bolt catch lever in an extended configuration.
Figure 6:
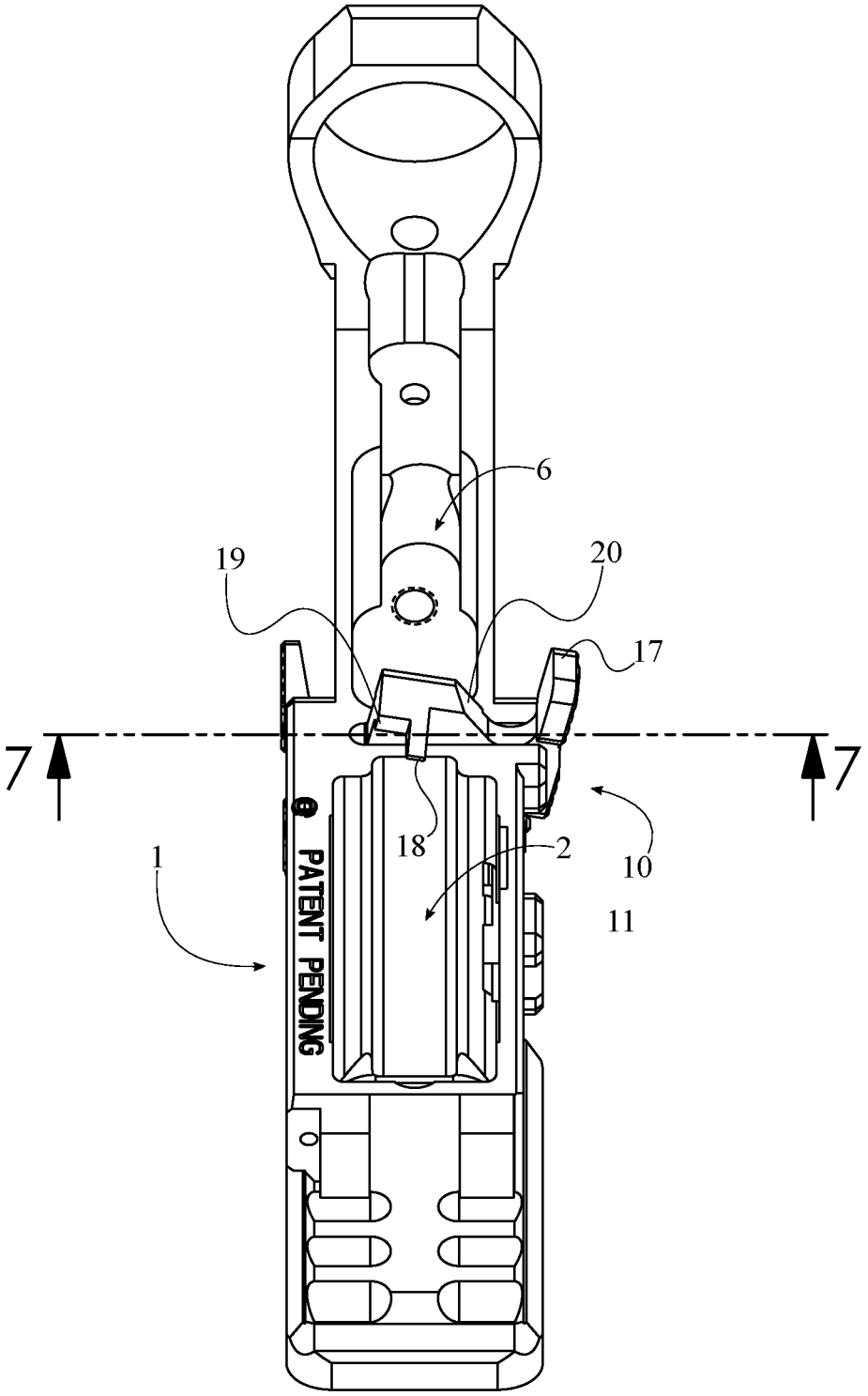
FIG. 6 is a top side view of the present invention with the bolt catch button disengaged and the bolt catch lever in the extended configuration.
Figure 8:
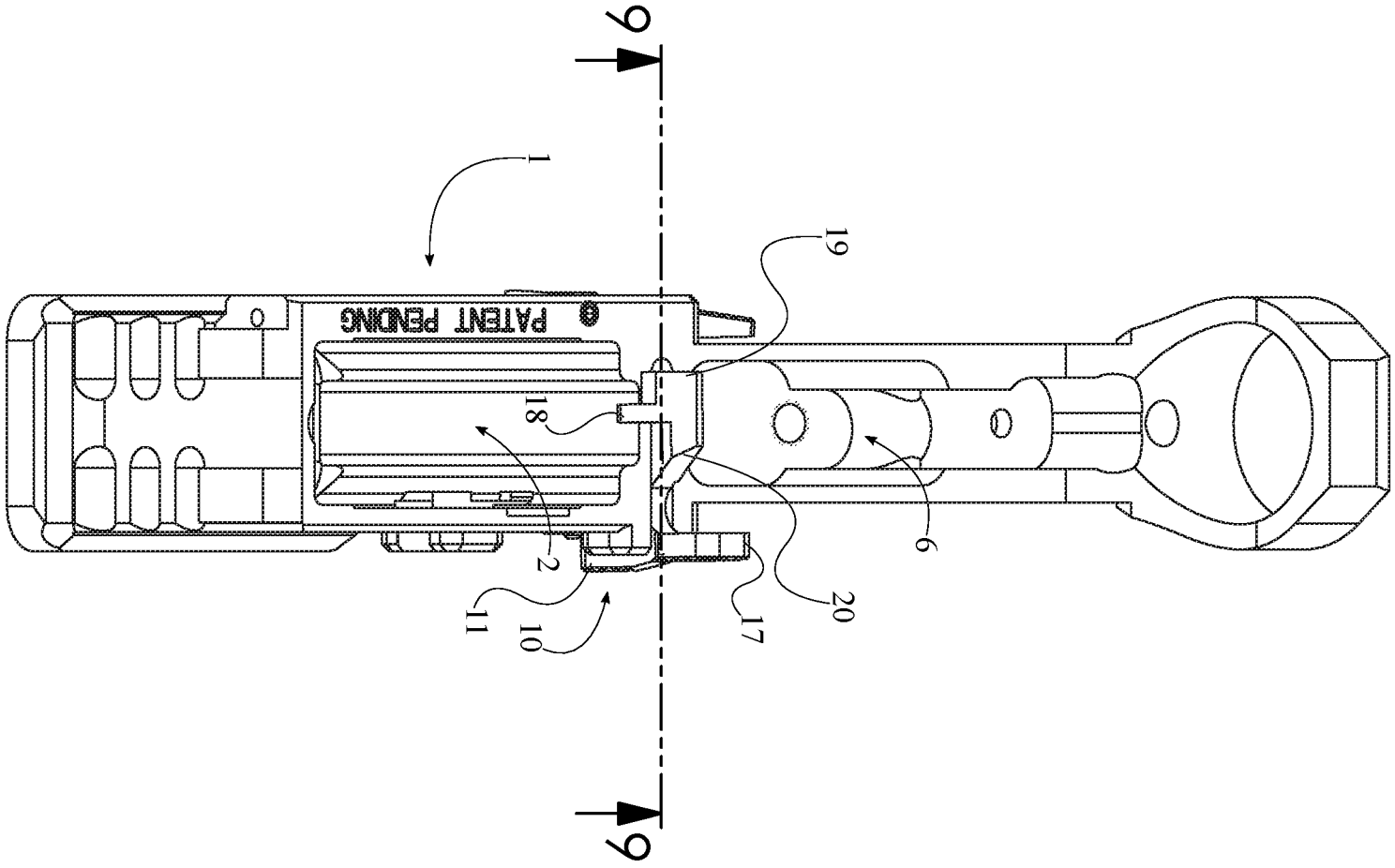
FIG. 8 is a top side view of the present invention with the bolt catch button fully engaged and the bolt catch lever in the retracted configuration.

A user operates the present invention by depressing the bolt catch button 9 in order to engage the bolt catch lever 10 while in a neutral configuration shown in FIG. 2 and FIG. 3. The pusher finger 22 pivots counter-clockwise and locking groove 30 releases the lip 21 of the bolt catch lever 10. Simultaneously, the hooking tab 32 pushes against the lip 21, and consequently the first portion 15 of the main plate 11, as seen in FIG. 4 and FIG. 5. The rifle bolt in the bolt carrier assembly of the upper receiver then presses against the locking tab 18 of the bolt catch lever 10, locking the rifle bolt of the bolt carrier assembly. The user releases the bolt catch button 9 which pivots the pusher finger 22 and the hooking tab 32 locks into the finger groove 28 of the length-adjustable pin 25, as seen in FIG. 6 and FIG. 7. The release of the bolt catch button 9 allows the bolt catch lever 10 to remain stationary as a result of the rifle bolt. The user then pushes the bolt catch button 9 further into the button slot 5, thereby engaging the pusher finger 22 and the length-adjustable pin 25 again. The bolt catch lever 10 is then pushed until the locking tab 18 overcomes the friction and force of the rifle bolt. The bolt catch lever 10 then releases the rifle bolt, as seen in FIG. 8 and FIG. 9.

Although the invention has been explained in relation to its preferred embodiment, it is to be understood that many other possible modifications and variations can be made without departing from the spirit and scope of the invention as hereinafter claimed.

What is claimed is:

1. An ambidextrous lower receiver for an automatic rifle comprising:

a lower-receiver body;

a bolt catch button;

a bolt catch lever;

a pusher finger;

a length-adjustable pin;

the lower-receiver body comprises a magazine chamber, an actuation chamber, a lever slot, and a button slot;

the magazine chamber traversing through the lower-receiver body;

the actuation chamber being positioned adjacent to the magazine chamber;

the lever slot and the button slot laterally traversing through the lower-receiver body and into the actuation chamber;

the lever slot being positioned opposite to the button slot across the actuation chamber;

the bolt catch lever being pivotably mounted within the lever slot;

the bolt catch button being slidably engaged within the button slot;

a first end of the pusher finger being pivotably mounted onto the bolt catch button; and the length-adjustable pin being operatively coupled in between the pusher finger and the bolt catch lever, wherein the length-adjustable pin causes the pusher finger and the bolt-catch lever to rotate toward each other.

2. The ambidextrous lower receiver for an automatic rifle as claimed in claim 1, wherein the lower-receiver body further comprises a trigger mechanism chamber and a trigger guard;

the trigger mechanism chamber traversing through the lower-receiver body;

the trigger mechanism chamber being positioned adjacent the actuation chamber, opposite the magazine chamber along the lower-receiver body; and the trigger guard being connected adjacent to the lower-receiver body;

the trigger guard being positioned adjacent the trigger mechanism chamber along the lower-receiver body.

3. The ambidextrous lower receiver for an automatic rifle as claimed in claim 1, wherein the bolt catch lever comprises a main plate, a release tab, a locking tab, and a stopping plate;

a rotation axis of the main plate being oriented parallel to a sagittal plane of the lower-receiver body;

the release tab and the stopping plate being fixed to the main plate, externally positioned adjacent the lever slot;

the stopping plate being fixed to a first outer edge of the main plate, opposite the release tab;

a second outer edge of the main plate being positioned adjacent and oriented perpendicular to the first outer edge;

the locking tab being terminally fixed to the stopping plate, opposite the main plate;

the stopping plate being oriented perpendicular to the main plate and the locking tab; and the locking tab being oriented towards the magazine chamber.

4. The ambidextrous lower receiver for an automatic rifle as claimed in claim 3, wherein the bolt catch lever further comprises a relief cut;

the relief cut traversing into the main plate; and the relief cut being positioned along the first outer edge, between the release tab and the stopping plate.

5. The ambidextrous lower receiver for an automatic rifle as claimed in claim 1 further comprising:

a locking groove;

the bolt catch lever comprises a main plate, a release tab, and a lip;

the main plate comprises a first portion and a second portion;

the second portion being terminally fixed to the first portion;

the first portion being oriented perpendicular to the second portion;

the lip being positioned within the lever slot;

the lip being connected adjacent to the first portion;

the locking groove traversing into a second end of the pusher finger, opposite to the bolt catch button; and the lip engaging into the locking groove.

6. The ambidextrous lower receiver for an automatic rifle as claimed in claim 1 further comprising:

a pushing tab;

a hooking tab;

the length-adjustable pin comprises a first rod, a second rod, a finger groove, and a spring;

the pushing tab being connected adjacent to the first end of the pusher finger;

the hooking tab being connected adjacent to the second end of the pusher finger, opposite to the bolt catch button;

the first rod being pressed against the pushing tab;

the second rod being pressed against the bolt catch lever;

the spring being connected in between the first rod and the second rod;

the finger groove laterally traversing into the second rod; and the hooking tab engaging into the finger groove.

7. The ambidextrous lower receiver for an automatic rifle as claimed in claim 6 further comprising:

a pin tube;

a pusher slot;

the pin tube being mounted within the actuation chamber;

the length-adjustable pin being slidably engaged within the pin tube;

the pin tube being positioned in between the pusher finger and the length-adjustable pin;

the pusher slot being positioned adjacent to the bolt catch lever;

the pusher slot laterally traversing into the pin tube; and the hooking tab engaging through the pusher slot and into the finger groove.

8. The ambidextrous lower receiver for an automatic rifle as claimed in claim 6, wherein the spring forces the second rod towards the bolt catch lever, wherein displacement of the second rod causes the bolt catch lever to rotate about the pivoting connection with the lower-receiver body.

9. The ambidextrous lower receiver for an automatic rifle as claimed in claim 6, wherein the spring forces the first rod towards the pushing tab, wherein displacement of the first rod causes the pusher finger to rotate about the pivoting connection with the bolt catch button.

10. The ambidextrous lower receiver for an automatic rifle as claimed in claim 6: wherein the spring forces the second rod towards the bolt catch lever, wherein displacement of the second rod causes the bolt catch lever to rotate about the pivoting connection with the lower-receiver body.

11. The ambidextrous lower receiver for an automatic rifle as claimed in claim 1: wherein the bolt catch lever comprises a main plate, a release tab, a locking tab, and a stopping plate, and the bolt catch lever further comprises;

a rotation axis of the main plate being oriented parallel to a sagittal plane of the lower-receiver body;

the release tab and the stopping plate being fixed to the main plate, externally positioned adjacent the lever slot;

the stopping plate being fixed to a first outer edge of the main plate, opposite the release tab;

a second outer edge of the main plate being positioned adjacent and oriented perpendicular to the first outer edge;

the locking tab being terminally fixed to the stopping plate, opposite the main plate;

the stopping plate being oriented perpendicular to the main plate and the locking tab;

the locking tab being oriented towards the magazine chamber;

the relief cut traversing into the main plate; and the relief cut being positioned along the first outer edge, between the release tab and the stopping plate.

* * * * *